US006309483B1

(12) United States Patent
Wang et al.

(10) Patent No.: US 6,309,483 B1
(45) Date of Patent: Oct. 30, 2001

(54) METHOD AND DEVICE FOR ELIMINATING STRIP VIBRATION IN ZONES INTO WHICH GAS IS BLOWN, PARTICULARLY COOLING ZONES

(75) Inventors: Robert Wang, Wissous; François Mignard, Mennecy, both of (FR)

(73) Assignee: Stein Heurtey, Ris-Orangis (FR)

( * ) Notice: Subject to any disclaimer, the term of this patent is extended or adjusted under 35 U.S.C. 154(b) by 0 days.

(21) Appl. No.: 09/611,956

(22) Filed: Jul. 6, 2000

(30) Foreign Application Priority Data

Jul. 6, 1999 (FR) ..... 99 08709

(51) Int. Cl.[7] ..... C21D 1/667; C21D 9/573; C21D 9/52; F26B 19/00

(52) U.S. Cl. ..... 148/661; 34/62; 266/113

(58) Field of Search ..... 266/81, 89, 83, 266/92, 111, 113; 34/62, 67, 65, 66; 148/537, 656, 660, 661, 508, 559

(56) References Cited

U.S. PATENT DOCUMENTS 3,068,586 12/1962 Vaughan et al. .
3,680,756 8/1972 Hirai et al. .
4,625,431 12/1986 Nanba et al. .
5,137,586 8/1992 Klink .
5,885,382 3/1999 Sakurai et al. .

FOREIGN PATENT DOCUMENTS 61-117232 6/1986 (JP) .

*Primary Examiner*—Deborah Yee
(74) *Attorney, Agent, or Firm*—Connolly Bove Lodge & Hutz

(57) ABSTRACT

Method for eliminating vibration of strip travelling continuously through zones of a heat treatment or coating line in which gas is blown onto a strip travelling continuously, particularly through devices which effect cooling by blowing gas in jets with which the lines for the continuous heat treatment or coating of metal strip are equipped, characterized in that this method consists in adjusting the pressure and/or the flow rate of the cooling gas to a value lower than the nominal value in a zone located at one edge of the strip, on one side thereof, and to a value lower than the nominal value on the opposite edge, located on the other side of the strip.

15 Claims, 3 Drawing Sheets

METHOD AND DEVICE FOR ELIMINATING STRIP VIBRATION IN ZONES INTO WHICH GAS IS BLOWN, PARTICULARLY COOLING ZONES

The present invention relates to a method and to a device which are intended to eliminate vibration of strips moving continuously through zones of a heat treatment or coating line where gas is blown onto a continuously moving strip. The invention is most especially applicable, without however being restricted to this application, to cooling devices which work by blowing gas in jets with which the lines for the continuous heat treatment or coating of metal strip are equipped.

In order to permit a good understanding of the technical field to which the present invention applies, reference is first of all made to FIG. 1 of the appended drawings which depicts, diagrammatically and in perspective, a rapid cooling zone 2 employing the blowing of gas in jets, according to the state of the prior art, through which a metal strip 1 passes, passing over rollers 3 and 12. As it passes through the cooling zone 2, the strip 1 is exposed to the jets of cooling gas blown out of a number of pairs of boxes such as 4 and 5, each box being positioned one on each side of the strip 1. The cooling boxes 4 and 5 are of limited length so as to allow one or a pair of stabilizing rollers such as 9 and 10 to be installed, these rollers being placed between two consecutive boxes as clearly shown in FIG. 1 and which are intended to guide and stabilize the strip and, in particular, to limit the extent to which the latter vibrates under the action of the cooling jets.

The blower boxes 4 and 5 may be split transversely into a number of boxes such as 6, 7 and 8 equipped with independent gas supply means 13, 14 and 15 and the supply flow rate and/or pressure characteristics of which can be regulated according to the level of cooling to be effected on the strip.

There are various embodiments of means that allow cooling gas to be blown onto strip. U.S. Pat. No. 3,068,586 describes a certain number of embodiments of these blowing means. FIG. 2 of the appended drawings depicts, diagrammatically and in perspective, a cooling box 4 of known type, equipped with blow holes 16, the diameter and pattern of which are tailored to the desired level of cooling. FIG. 3 is a depiction similar to FIG. 2 but in which the cooling box 4 of known type has cylindrical blower nozzles 17 arranged in a rectangular or diamond-shaped pattern over the entire surface of the box 4. Finally, FIG. 4 depicts, in a view similar to FIGS. 2 and 3, a known alternative form of blower box 4 which is equipped with blower nozzles in the form of slots 18 arranged across the entire width of the box.

The cooling gas blown onto the strip through the holes 16, the nozzles 17 or the nozzles 18 is ducted transversely across the entire width of the box, between this box and the strip, so that it can be recycled through ducts located outside the cooling zone 2. The means which fulfil these functions are well known to those skilled in the art and have not been depicted in FIG. 1.

The increase in performance of lines for the continuous heat treatment of metal strip, and the search for increasing cooling gradients have entailed moving the holes 16 or the nozzles 17 or 18 closer to the strip 1 and the use of increasingly high cooling-gas blowing flow rates and/or pressure. This change has lead to the emergence of a new problem in this type of cooling zone, namely the vibration of the strip between the cooling boxes, this vibration phenomenon being limited or unknown in equipment produced according to the state of the prior art.

FIG. 5 of the appended drawings depicts sections on a horizontal plane through the blower boxes 4 and 5. For a theoretical stable situation, the distance between the strip and the boxes 4 and 5 is equal to the distance denoted by the reference a, the blowing flow rates in the boxes 4 and 5 denoted by Vn and Vs are equal. Having been blown onto the strip, the gas is collected along Vn1 and Vn2 and also along Vs1 and Vs2. This equilibrium is characterized by Vn1 =Vn2 and Vs1 =Vs2.

FIG. 6 of the appended drawings depicts a strip which has a heterogeneous distribution of tension across its width, the tension being greater at the centre of the strip than at the edges, as a result, perhaps, of the rolling process, the profile of the rollers or heterogeneous heating or cooling, or as a result of some other phenomenon. In this configuration, the strip tension is concentrated in its central region, the longer edges of the strip being less taut. This difference in tension with "floppy" edges may give rise to a variation in the distance between the edges of the strip 1 and the boxes 4 and 5, according to b and c, which leads to the variation in flow rates V's1, V's2, V'i1 and V'i2. In this example, V'n1 is smaller than V'n2 and V's1 is greater than V's2. Under this action, the strip shifts into a maximum position for which the pressure on side b increases and the pressure on side c decreases, and the opposite movement begins. This phenomenon causes torsional vibration of the strip, symmetrical or otherwise, which can be represented according to FIG. 7 which illustrates this vibration between two consecutive rollers. This vibration in the zones where blowing is at a high flow rates may reach amplitude values such that they can cause contact between the holes 16, the nozzles 17 or 18 and the strip, which of course causes surface defects to appear on the strip 1, thus degrading the product obtained. Furthermore, strip vibration may be such that it leads to damage to the cooling boxes and to their blow holes or nozzles.

To solve this problem, attempts have been made, in the prior art, at limiting the vibration by reducing the length of the blower boxes so as to be able to bring the stabilizing rollers 9 and 10 (FIG. 1) closer together. However, this technique limits the useful blowing length and therefore the effectiveness of the cooling in the zone.

Another attempt at solving this problem has consisted in greatly increasing the strip tension, but this solution is possible only for greater strip thicknesses and cannot be used for high-temperature strip, thinner strip and great widths or on account of the mechanical strength properties of treated steels of which the strips are made.

The solution generally adopted in the state of the prior art for eliminating or at least reducing strip vibration consists in increasing the distance between the holes 16 or the nozzles 17 or 18 and the strip 1 or in limiting the blowing pressure in the boxes, these solutions leading to a limiting of the effectiveness of the cooling and resulting in a reduction in the productivity of the line in a proportion which may be as much as 40% of nominal productivity.

Furthermore, defects in the rolling of the strips that are to be treated, particularly the long edges, increase the risk that a strip exposed to a regime of recycled gases blown onto an unstable strip will begin to vibrate. Furthermore, the change in grades of steel currently treated is dictating increasingly steep cooling gradients cooling from increasingly high temperatures with low strip tensions, thus causing the appearance of strip torsional vibration to become more widespread.

The present invention has therefore set itself the objective of solving the above problem, that is to say of eliminating strip vibration in the cooling zones by improving the collection of the cooling gases between the strip and the blower box and by forcing the strip into a fixed position.

In consequence, the first object of the invention is a method for eliminating vibration of strip travelling continuously through zones of a heat treatment or coating line in which gas is blown onto a strip travelling continuously, particularly through devices which effect cooling by blowing gas in jets with which the lines for the continuous heat treatment or coating of metal strip are equipped, characterized in that this method consists in adjusting the pressure and/or the flow rate of the cooling gas to a value lower than the nominal value in a zone located at one edge of the strip, on one side thereof, and to a value lower than the nominal value on the opposite edge, located on the other side of the strip.

Another object of the invention is a device for eliminating vibration of strip travelling continuously through zones which effect cooling by blowing gas in jets with which the lines for the continuous heat treatment of metal strip are equipped, this device employing the method as defined hereinabove and being characterized in that it comprises blower boxes comprising means to allow the pressure and/or the flow rate of the cooling gas to be adjusted to a value lower than the nominal value in a zone located on one edge of the strip in the box located on one side of the strip and to a value lower than the nominal value on the opposite edge, on the box located on the other side of the strip.

Other features and advantages of the present invention will become apparent from reading the description given hereinafter with reference to the appended drawings. In the drawings:

Figure 8:
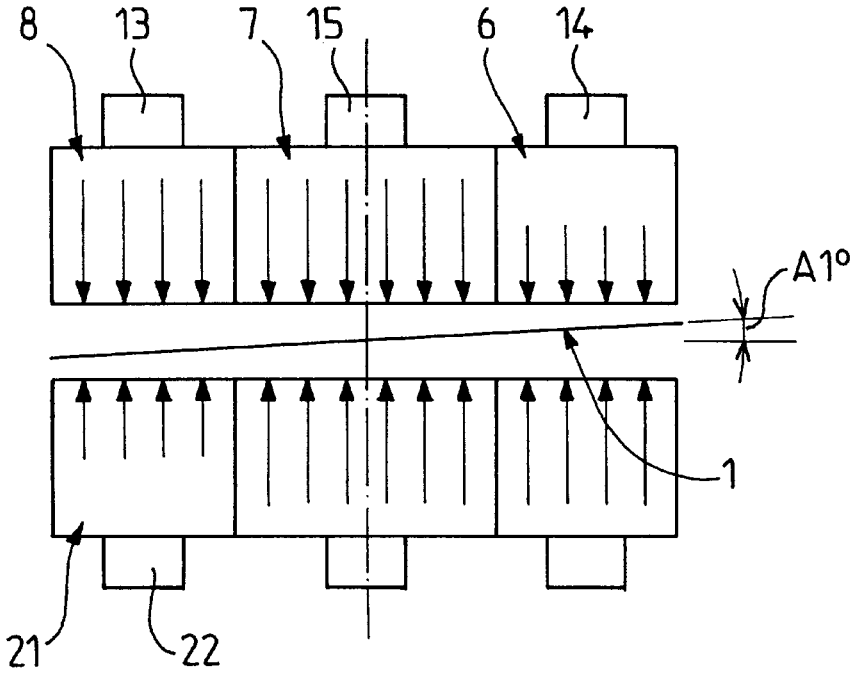
FIG. 8 illustrates a dual blower box in accordance with a first embodiment of the invention.

Reference is first of all made to FIG. 8 which very diagrammatically in section on a horizontal plane depicts two blower boxes 8 and 21 arranged one on each side of the continuously moving strip 1. In this figure, it can be seen that each box is divided into a number of elemental boxes. Thus, the box 8 is split into three boxes 8, 7 and 6, each individually supplied with blowing gas at 13, 15 and 14.

According to the present invention, each of the supplies to the boxes is equipped with means for adjusting the supply flow rate and/or pressure of the corresponding box. These means are produced and used in such a way as to obtain asymmetry (from right to left) in the blowing onto the strip 1, as depicted in FIG. 8, thus causing a direction in which the gases for collection are encouraged to flow across a strip kept in a position of equilibrium. In consequence, these means make it possible to obtain a lower pressure level in the end box 6 on one side of the strip and on the opposite end box 21 on the other side of the strip. In FIG. 8, arrows have been used to depict the resulting pressure level, in the various parts of the boxes on each side of the strip. The net result of this adjustment is that the strip experiences an asymmetric force field which gives it a position of equilibrium as depicted in FIG. 8, with a twist angle A1. This adjustment of the transverse pressure in the blower box opposes any torsional movement of the strip and forces the strip to remain in its predefined position or, at least, limits the amplitude of its vibration.

In the embodiment described hereinabove with reference to FIG. 8, the boxes such as 8 and 21 are split into a number of elemental boxes. It has thus been seen that, in this embodiment which is not in any way limiting, the box 8 was divided into three boxes 8, 7 and 6, each individually supplied with blowing gas at 13, 15 and 14 respectively. According to the present invention, these supply means are equipped with means for adjusting the pressure and/or the flow rate of the cooling gas so as to obtain the above-specified right-left asymmetry across the strip.

According to another embodiment of the invention, the pressure of the cooling gas is adjusted by creating, in a single box, pressure drops which enable the pressure of the gas jets in the above-defined zones to be limited, making it possible to obtain the desired asymmetry, it being possible for this pressure drop to be fixed or variable with, in particular, the possibility of altering the value of the pressure drop according to the vibration that is to be combated.

According to the present invention, it is also possible to contrive for the blow boxes on the right and left sides of the strip to have different openings, encouraging the gases to collect towards the side where the collection sections are largest.

Still according to the present invention, suction means outside the cooling zone are provided, these being designed to extract gases to different extents on the right and left sides of the strip, thus creating a preferred direction in which the gases are encouraged to flow.

According to another embodiment of the present invention, the desired asymmetry is obtained by varying the length of the blow nozzles, when these are of the tubular type, between the right side and left side of the boxes.

Figure 1:
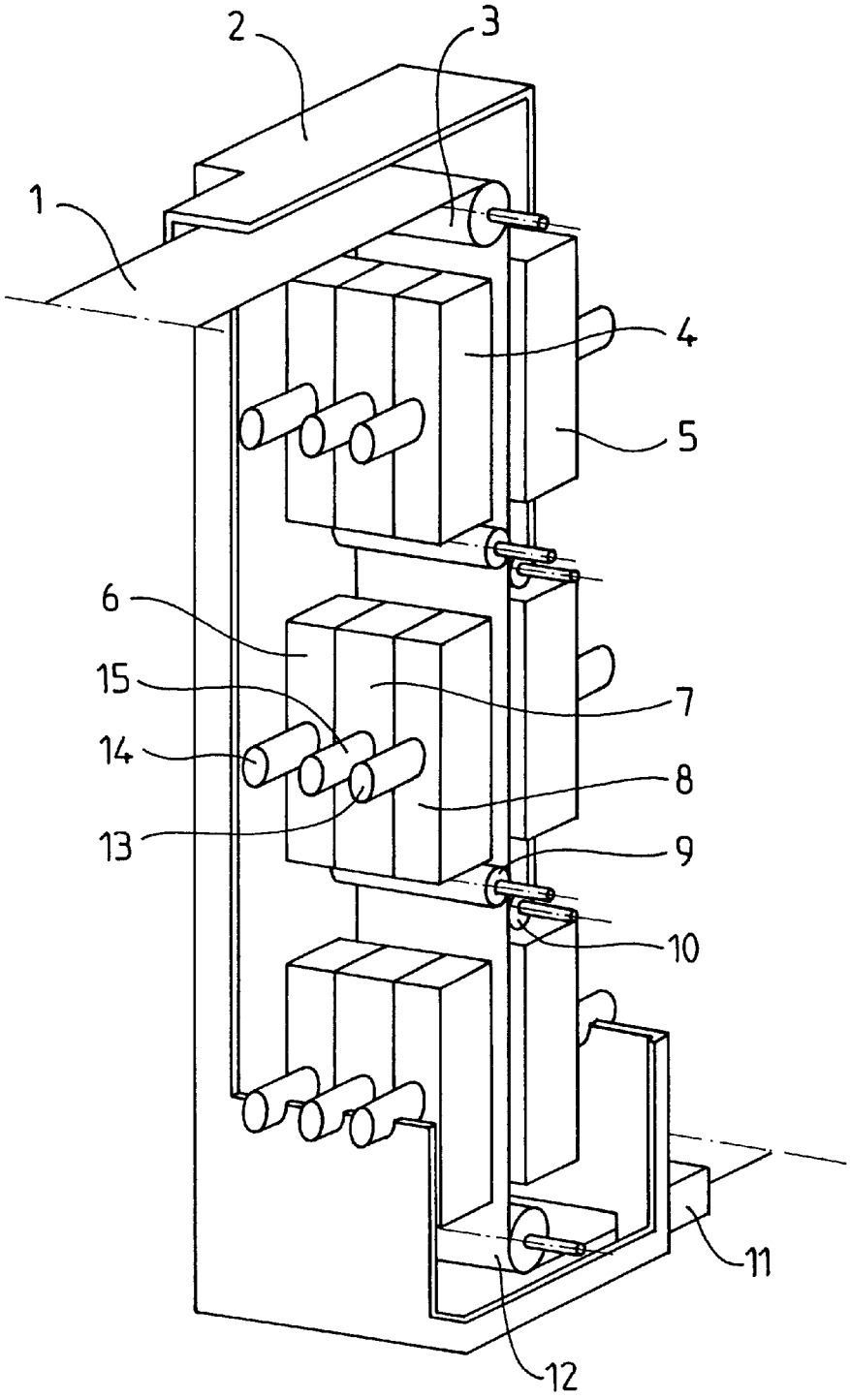
FIG. 1 is a perspective diagram of a conventional rapid cooing zone employing gas jets through which a metal strip passes.
Figure 2:
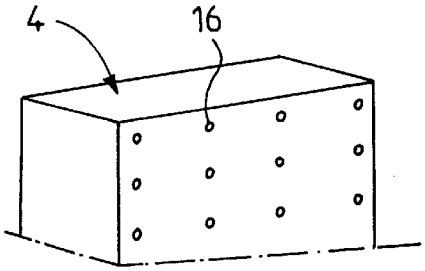
FIG. 2 is a perspective diagram of a conventional cooling box equipped with blow holes.
Figure 3:
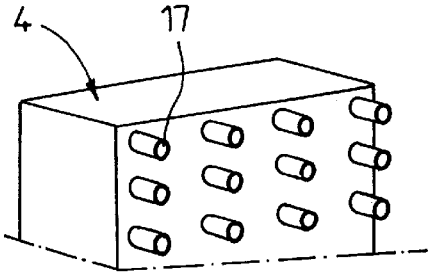
FIG. 3 is a perspective diagram of a conventional cooling box with cylindrical blower nozzles arranged in a rectangular or diamond-shaped pattern.
Figure 4:
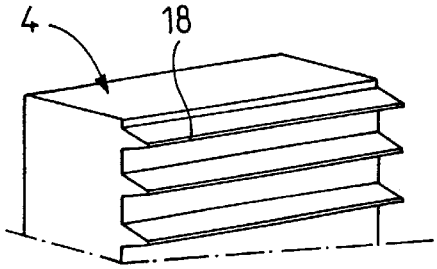
FIG. 4 is perspective diagram of a conventional cooling box with slot-shaped blower nozzles.
Figure 5:
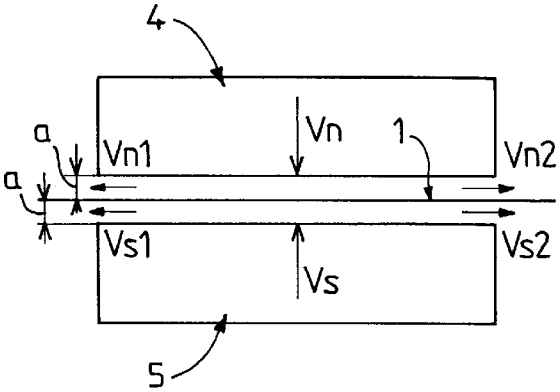
FIG. 5 illustrates a cross-sectional view of a horizontal plane through the blower boxes.
Figure 6:
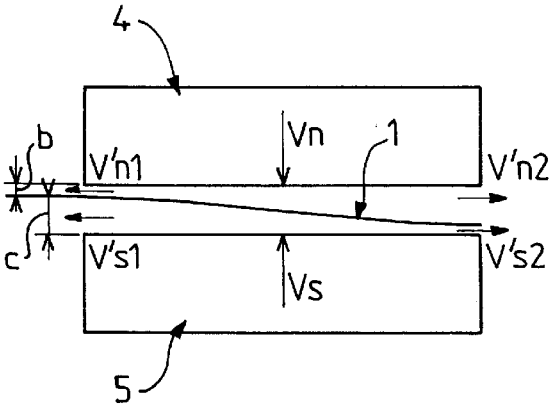
FIG. 6 illustrates a strip which has a heterogeneous distribution of tension across its width.
Figure 7:
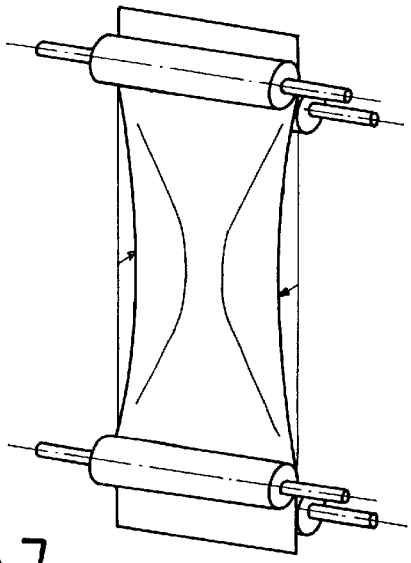
FIG. 7 illustrates torsional vibration of a strip between rollers.

According to the present invention, it is possible to provide means for twisting the strip between the roller 3 located at the top of the cooling zone 2 and the stabilizing rollers such as 9 and 10 in FIG. 1, along the length of a blower box, so as to immobilize the strip in an extreme position of its vibration range. These means may also be provided between two groups of stabilizing rollers.

Of course, all these devices can be used separately or in various combinations in order to obtain the desired result.

According to the present invention, the vibration of the strip, (the amplitude and its position) can be measured using appropriate sensors, the information from which is analyzed, by video images, in order to control the operations performed with a view to limiting the vibration of the strip, for example, the regulating of the pressures in the blower boxes or of the position of the said boxes.

Figure 9:
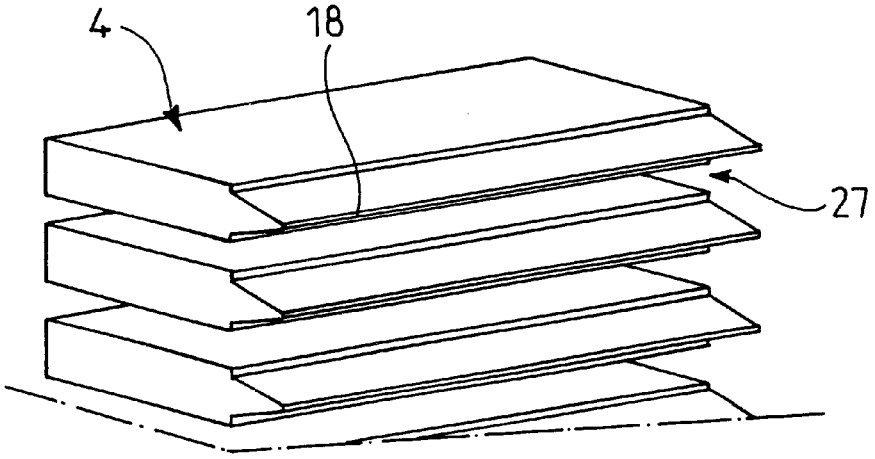
FIG. 9 illustrates a blower box and slotted blower nozzle of a second embodiment of the invention.

Reference is now made to FIG. 9 of the appended drawings which illustrate another embodiment of a blower box 4 equipped with blower nozzles 18 in the form of slots and designed with a view to eliminating the effect of the blower gases being removed at the sides after they have struck the strip. In this embodiment, the nozzles 18 are independent, and are generally supplied with cooling gas via their ends and are separated from one another in such a way as to form a gas collection zone 27 between two contiguous nozzles. By virtue of this arrangement, it is possible to collect from the rear the gases which have been blown onto the strip, this collection being from this space 27, at right angles to the strip, without the velocity vector of this collection having components parallel to the strip, the transverse component of the blowing gas collection velocity thus being eliminated. We therefore have $Vn1=Vn2=Vs1=Vs2=0$. The equality of the gas collection flow rates obtained through this means makes is possible to achieve strip stability, thus contributing to solving the aforementioned problem. Of course, without departing from the scope of the present invention, the blower box 4 could be equipped with blower nozzles 18 consisting of a series of holes supplied in the way described hereinabove.

It is evident from reading the aforegoing description that the invention does actually provide means for limiting the instability of the cooling gas collection flows circulating towards the edges of the strip and which cause the previously-observed torsional vibration of the strip. It is therefore possible, by virtue of the invention, to operate with low strip tensions and high coolant gas flow rates and/or pressures thus making it possible to obtain quick cooling cycles.

The invention makes it possible to eliminate the limitations on productivity which were imposed by the absence of control of the vibration of the strip in equipment according to the state of the prior art. It also makes it possible to eliminate surface defects which are found in equipment according to the prior art when the strip and the cooling boxes come into contact.

Employing the invention also makes it possible to eliminate:

the mechanical stresses introduced into the strip via the vibration;

the risk of the strip creasing as a result of its vibration, and the noise caused by strip vibration.

It of course remains understood that the present invention is not restricted to the embodiments described and/or mentioned hereinabove but that it encompasses all alternative forms thereof. Furthermore, and as mentioned in the preamble of the present description, this invention is not restricted to cooling devices but can also be applied in all zones of a heat treatment or coating line in which gas is blown onto a continuously moving strip.

What is claimed is:

1. Method for eliminating vibration of strip travelling continuously through zones of a heat treatment or coating line in which gas is blown onto a strip travelling continuously, particularly through devices which effect cooling by blowing gas in jets with which the lines for the continuous heat treatment or coating of metal strip are equipped, characterized in that this method consists in adjusting the pressure and/or the flow rate of the cooling gas to a value lower than the nominal value in a zone located at one edge of the strip, on one side thereof, and to a value lower than the nominal value on the opposite edge, located on the other side of the strip.

2. Method according to claim 1, characterized in that the pressure of the cooling gas is adjusted by creating, inside a single box, pressure drops which allow the pressure of the gas jets in the zones to be limited, in order to achieve the desired asymmetry.

3. Method according to claim 2, characterized in that the said pressure drop is fixed.

4. Method according to claim 2, characterized in that the said pressure drop is variable, it being possible for its value to be altered according to the vibration that is to be combated.

5. Device for eliminating vibration of strip travelling continuously through zones of a heat treatment or coating line in which gas is blown onto a strip travelling continuously, particularly through devices which effect cooling by blowing gas in jets with which the lines for the continuous heat treatment or coating of metal strip are equipped, this device employing the method according to claim 1 comprising blower boxes provided with blowing means and comprising means for allowing the pressure and/or the flow rate of the cooling gas to be adjusted to a value lower than the nominal value in a zone located on one edge of the strip in the box located on one side of the strip and to a value lower than the nominal value on the opposite edge, in the box located on the other side of the strip.

6. Device according to claim 5, wherein the blower boxes are split up into a number of elemental boxes each supplied individually with blowing gas by an independent supply means equipped with means for adjusting the pressure and/or the flow rate of the cooling gas.

7. Device according to claim 5 wherein the cooling gases, having been blown onto the strip, are collected, from the rear, between the blowing means of the boxes.

8. Device according to claim 7, wherein each blower box is equipped with blower nozzles in the form of slots or of a series of holes, these nozzles, supplied independently with cooling gas, being separated from one another so as to form a zone for collecting the gases between two contiguous nozzles.

9. Device according to claim 5 wherein the opening of the blower boxes differs between the right side and the left side of the strip, so as to encourage the gases to collect towards the side where the collection sections are the greatest.

10. Device according to claim 5 further comprising suction means outside the cooling zone and designed to extract gases to different extents on the right and left sides of the strip, thus creating a preferred direction in which the gases are encouraged to flow.

11. Device according to claim 5, wherein the blower boxes are fitted with tubular blower nozzles, the length of the said blower nozzles varies between the right side and the left side of the said boxes.

12. Device according to claim 5 further comprising means that allow the strip to be twisted between the roller located at the top of the cooling zone and stabilizing rollers, or between two groups of stabilizing rollers along the length of a blower box, so as to immobilize the strip in an extreme position in its range of vibration.

13. Device according to claim 5 further comprising means that allow the strip to be twisted between two groups of stabilizing rollers along the length of a blower box, so as to immobilize the strip in an extreme position in its range of vibration.

14. Device according to claim 5, further comprising sensors for detecting the vibration of the strip, that is to say the amplitude and its position, the information delivered from said sensors being analyzed in order to control the operations performed with a view to limiting the vibration of the strip, such as the regulating of the pressures in the blower boxes or of the position of the said boxes.

15. Line for the continuous heat treatment or coating of metal strip comprising the blowing of a gas onto this strip and, in particular, zones where cooling is effected by blowing gas in jets, comprising a device for eliminating strip vibration according to claim 5.

* * * * *